US008314758B2

(12) United States Patent
Goh et al.

(10) Patent No.: US 8,314,758 B2
(45) Date of Patent: Nov. 20, 2012

(54) DISPLAY DEVICE

(75) Inventors: Joon-Chul Goh, Hwaseongi-si (KR); Chong-Chul Chai, Seoul (KR); Young-Soo Yoon, Suwon-si (KR); Sei-Hyoung Jo, Seoul (KR)

(73) Assignee: Samsung Display Co., Ltd. (KR)

( * ) Notice: Subject to any disclaimer, the term of this patent is extended or adjusted under 35 U.S.C. 154(b) by 1087 days.

(21) Appl. No.: 12/240,939

(22) Filed: Sep. 29, 2008

(65) Prior Publication Data

US 2009/0278831 A1 Nov. 12, 2009

(30) Foreign Application Priority Data

May 7, 2008 (KR) ..... 10-2008-0042309

(51) Int. Cl.
*G09G 3/32* (2006.01)
*G09G 3/36* (2006.01)

(52) U.S. Cl. ..... 345/82; 83/87; 83/90; 83/92

(58) Field of Classification Search ..... 315/160, 315/167, 169.1, 169.3; 345/55, 76, 77, 80, 345/82, 83, 84, 87, 88, 90, 92
See application file for complete search history.

(56) References Cited

U.S. PATENT DOCUMENTS

| | | | | |
|---|---|---|---|---|
| 6,809,482 | B2 | 10/2004 | Koyama | |
| 7,141,934 | B2 | 11/2006 | Osame et al. | |
| 7,710,366 | B2 * | 5/2010 | Lee et al. | 345/82 |
| 2005/0012686 | A1 | 1/2005 | Osame et al. | |
| 2005/0259051 | A1 * | 11/2005 | Lee et al. | 345/76 |

FOREIGN PATENT DOCUMENTS

| | | | |
|---|---|---|---|
| JP | 2000-259098 | | 9/2000 |
| JP | 2005-037919 | | 2/2005 |
| JP | 2005-164880 | | 6/2005 |
| JP | 2005-202365 | | 7/2005 |
| JP | 2005-242341 | | 9/2005 |
| JP | 02005258407 A | * | 9/2005 |
| JP | 2005258407 A | * | 9/2005 |
| JP | 2006-215274 | | 8/2006 |
| JP | 2007-219533 | | 8/2007 |
| KR | 2005-0121697 | | 12/2005 |
| KR | 10-0645698 | | 11/2006 |
| KR | 2007-0066491 | | 6/2007 |

* cited by examiner

*Primary Examiner* — My-Chau T Tran
(74) *Attorney, Agent, or Firm* — Innovation Counsel LLP

(57) ABSTRACT

Embodiments of the present invention relate to a display device. In an embodiment, the display device includes a scanning signal line for transferring a scanning signal, a data line crossing the scanning signal line and transferring a data voltage, a switching transistor connected to the scanning signal line and the data line, a driving transistor connected to the switching transistor, a first transistor connected between the driving transistor and a driving voltage terminal, and a light-emitting element connected between the driving transistor and a common voltage terminal. The first transistor operates in a saturation region, and the driving transistor operates in a linear region. In this way, display characteristics may be improved by reducing deviation of a driving current due to deviation of characteristics of a driving transistor or a driving voltage.

18 Claims, 9 Drawing Sheets

DISPLAY DEVICE

CROSS-REFERENCE TO RELATED APPLICATION

This application claims priority to and the benefit of Korean Patent Application No. 10-2008-0042309 filed in the Korean Intellectual Property Office on May 7, 2008, the entire contents of which are incorporated herein by reference.

BACKGROUND (a) Technical Field

Embodiments of the present invention relate to a display device, and more particularly, to an organic light emitting device.

(b) Description of the Related Art

An organic light emitting device includes two electrodes and an emission layer interposed therebetween. The organic light emitting device emits light when electrons injected from an electrode, and holes injected from the other electrode, combine with each other at the emission layer to form excitons and the excitons radiate energy.

For this to occur, a thin film transistor array panel of an organic light emitting device includes a switching thin film transistor and a driving thin film transistor. The switching thin film transistor is connected to a signal line and controls application of a data voltage. The driving thin film transistor receives the data voltage as a control voltage from the switching thin film transistor and flows a current to a light-emitting element.

Meanwhile, if a thin film transistor is a three-terminal element having a control terminal, an input terminal, and an output terminal, an operation region of the thin film transistor may be divided into a linear region where an output current increases linearly according to a voltage between the input terminal and the output terminal, and a saturation region where the output current saturates to one value.

The deviation of the output current according to deviation of the voltage difference between the input terminal and the output terminal of the thin film transistor is large in the linear region even though the deviation of the output current according to deviation of the characteristics of the thin film transistor is small.

The above information disclosed in this Background section is only for enhancement of understanding of the background of the disclosure and therefore it may contain information that does not form the prior art that is already known in this country to a person of ordinary skill in the art.

SUMMARY

Embodiments of the present invention may provide a display device having improved display characteristics by reducing deviation of a driving current.

An exemplary embodiment of the present invention provides a display device including a scanning signal line, a data line, a switching transistor, a driving transistor, a first transistor, and a light emitting element. The scanning signal line transfers a scanning signal, the data line crosses the scanning signal line and transfers a data voltage, and the switching transistor is connected to the scanning signal line and the data line. The driving transistor is connected to the switching transistor. The first transistor is connected between the driving transistor and a driving voltage terminal, and the light-emitting element is connected between the driving transistor and a common voltage terminal. The first transistor operates in a saturation region, and the driving transistor operates in a linear region.

The first transistor may have a channel type identical to a channel type of the driving transistor.

The first transistor and the driving transistor may be n-channel MOS field effect transistors.

A control terminal of the first transistor may be connected to a first voltage terminal, and a control terminal of the driving transistor may be connected to an output terminal of the switching transistor.

A control terminal of the first transistor and a control terminal of the driving transistor may be connected to an output terminal of the switching transistor.

A ratio of a channel width to a channel length of the driving transistor may be smaller than a ratio of a channel width to a channel length of the first transistor.

The display device may further include a storage capacitor connected between the switching transistor and the first transistor.

The display device may further include a second transistor connected between the driving transistor and the light-emitting element, and operating in a saturation region.

The driving transistor may be a p-channel MOS field effect transistor.

The first transistor may be an n-channel MOS field effect transistor, and the second transistor may be a p-channel MOS field effect transistor.

A control terminal of the first transistor may be connected to a first voltage terminal, a control terminal of the driving transistor may be connected to an output terminal of the switching transistor, and a control terminal of the second transistor may be connected to a second voltage terminal.

A control terminal of the first transistor, a control terminal of the driving transistor, and a control terminal of the second transistor may be connected to an output terminal of the switching transistor.

A ratio of a channel width and a channel length of the driving transistor may be smaller than a ratio of a channel width and a channel length of the second transistor.

The driving transistor may be an n-channel MOS field effect transistor.

The first transistor may be an n-channel MOS field effect transistor, and the second transistor may be a p-channel MOS field effect transistor.

A control terminal of the first transistor may be connected to a first voltage terminal, a control terminal of the driving transistor may be connected to an output terminal of the switching transistor, and a control terminal of the second transistor may be connected to a second voltage terminal.

A control terminal of the first transistor, a control terminal of the driving transistor, and a control terminal of the second transistor may be connected to an output terminal of the switching transistor.

A ratio of a channel width to a channel length of the driving transistor may be smaller than a ratio of a channel width to a channel length of the first transistor.

The driving transistor may be an n-channel MOS field effect transistor.

The first transistor may be an n-channel MOS field effect transistor, and the second transistor may be a p-channel MOS field effect transistor.

A control terminal of the first transistor may be connected to a first voltage terminal, a control terminal of the driving transistor may be connected to an output terminal of the switching transistor, and a control terminal of the second transistor may be connected to a second voltage terminal.

A control terminal of the first transistor, a control terminal of the driving transistor, and a control terminal of the second transistor may be connected to an output terminal of the switching transistor.

A ratio of a channel width to a channel length of the driving transistor may be smaller than a ratio of a channel width to a channel length of the first transistor.

Another exemplary embodiment of the present invention provides a display device including a scanning signal line, a data line, a switching transistor, a driving transistor, a first transistor, and a light-emitting element. The scanning signal line transfers a scanning signal, the data line crosses the scanning signal line and transfers a data voltage, and the switching transistor is connected to the scanning signal line and the data line. The driving transistor is connected to the switching transistor. The first transistor is connected to the driving transistor, and the light-emitting element is connected to the first transistor. The first transistor operates in a saturation region, the driving transistor operates in a linear region, and a control terminal of the driving transistor and a control terminal of the first transistor are connected to an output terminal of the switching element.

The driving transistor may have a channel type that is identical to a channel type of the first transistor.

The driving transistor and the first transistor may be p-channel MOS field effect transistors.

A ratio of a channel width to a channel length of the driving transistor may be smaller than a ratio of a channel width to a channel length of the first transistor.

DETAILED DESCRIPTION

Embodiments of the present invention will be described more fully hereinafter with reference to the accompanying drawings, in which exemplary embodiments of the invention are shown. As those skilled in the art would realize, the described embodiments may be modified in various different ways, all without departing from the spirit or scope of the present disclosure.

Figure 1:
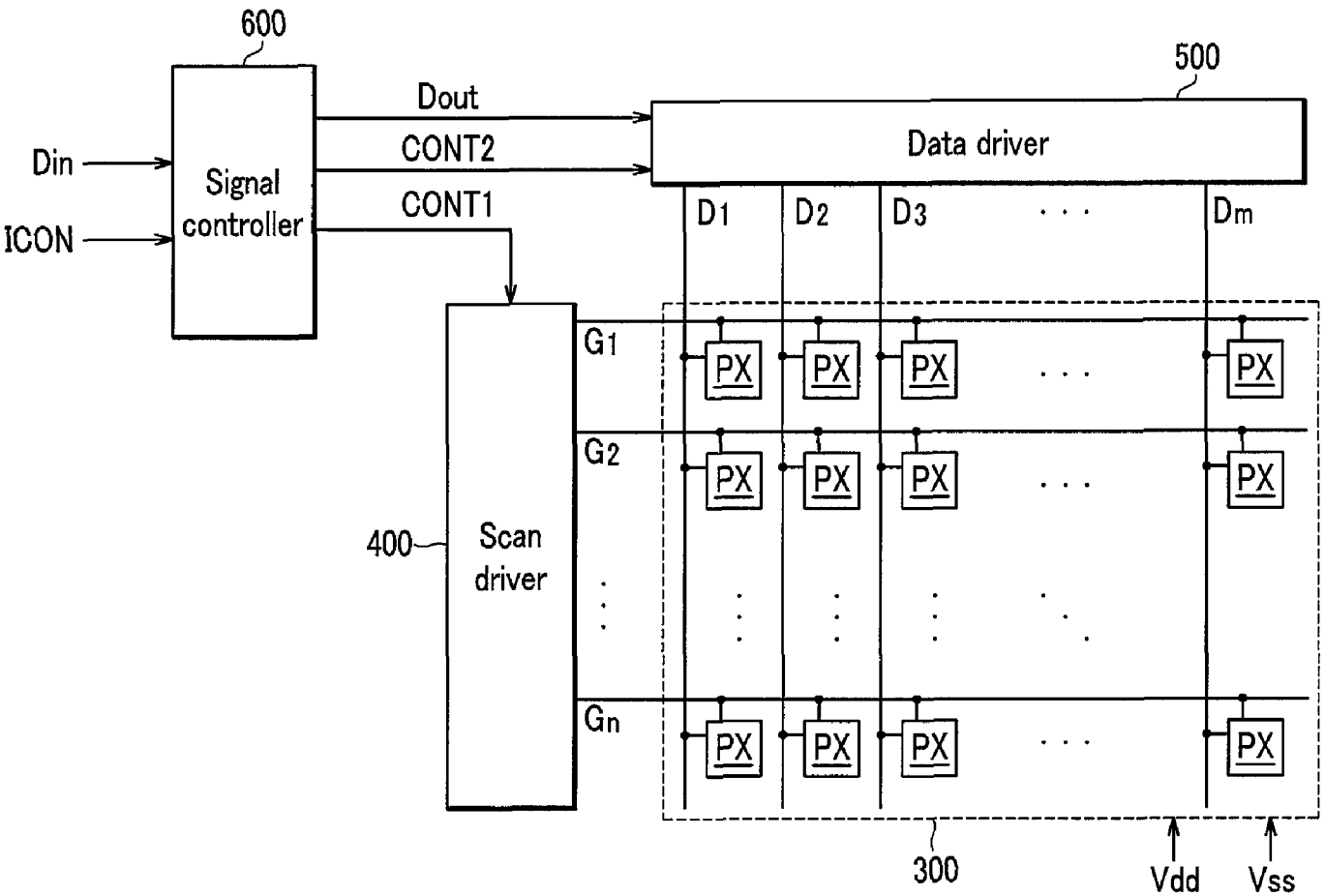
FIG. 1 is a block diagram of an organic light emitting device according to an exemplary embodiment of the present invention.
Figure 2:
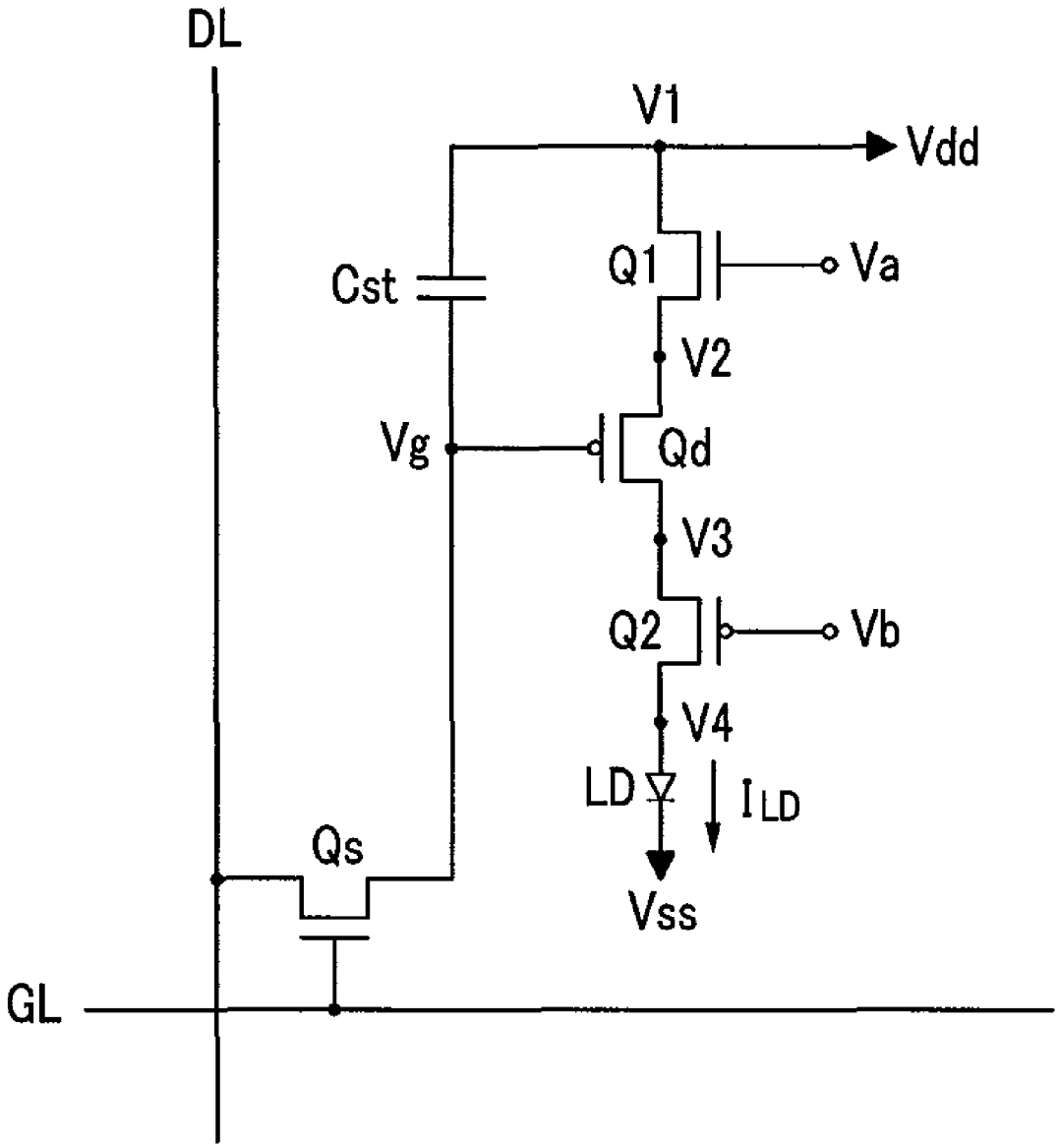
FIG. 2 is an equivalent circuit diagram of one pixel in an organic light emitting device according to an exemplary embodiment of the present invention.

With reference to FIG. 1 and FIG. 2, an organic light emitting device according to an exemplary embodiment of the present invention will be described.

FIG. 1 is a block diagram of an organic light emitting device according to an exemplary embodiment of the present invention, and FIG. 2 is an equivalent circuit diagram of one pixel in an organic light emitting device according to an exemplary embodiment of the present invention.

Referring to FIG. 1, the organic light emitting device according to an exemplary embodiment of the present invention includes a display panel 300, a scan driver 400, a data driver 500, and a signal controller 600.

The display panel 300 includes a plurality of signal lines $G_1$-$G_n$ and $D_1$-$D_m$, a plurality of voltage lines (not shown), and a plurality of pixels PX connected thereto and arranged in a matrix form.

The signal lines $G_1$-$G_n$ and $D_1$-$D_m$ include a plurality of scanning signal lines $G_1$-$G_n$for transferring scanning signals and a plurality of data lines $D_1$-$D_m$ for transferring data signals. The scanning signal lines $G_1$-$G_n$ extend basically in a row direction running substantially parallel to each other, and the data lines $D_1$-$D_m$ extend basically in a column direction running substantially parallel to each other.

The voltage lines include a driving voltage line (not shown) for transferring a driving voltage.

As shown in FIG. 2, each pixel PX includes a switching transistor Qs, an organic light emitting element LD, a driving transistor Qd, a storage capacitor Cst, and upper and lower transistors Q1 and Q2.

Each of the switching transistor Qs, the driving transistor Qd, and the upper and lower transistors Q1 and Q2 is a three-terminal element such as a thin film transistor having a control terminal, an input terminal, and an output terminal.

The switching transistor Qs includes a control terminal connected to a scanning signal line GL, an input terminal connected to the data line DL, and an output terminal connected to the driving transistor Qd. The switching transistor Qs transfers a data voltage, which is applied to the data line DL, to the driving transistor Qd in response to a scanning signal applied to the scanning signal line GL.

The driving transistor Qd includes a control terminal connected to the switching transistor Qs, an input terminal connected to the upper transistor Q1, and an output terminal connected to the lower transistor Q2.

The upper transistor Q1 includes a control terminal connected to the first voltage Va terminal, an input terminal connected to the driving voltage Vdd terminal, and an output terminal connected to the driving transistor Qd.

The lower transistor Q2 includes a control terminal connected to the second voltage Vb terminal, an input terminal connected to the driving transistor Qd, and an output terminal connected to the organic light emitting element LD.

The storage capacitor Cst is connected between the control terminal of the driving transistor Qd and the input terminal of the upper transistor Q1. The storage capacitor Cst stores a data voltage applied to the control terminal of the driving transistor Qd and sustains it even after the switching transistor Qs is turned off.

The organic light emitting element LD, which may be an organic light emitting diode (OLED), includes an anode connected to the output terminal of the lower transistor Q2 and a cathode connected to a common voltage Vss. The organic light emitting element LD emits light having an intensity depending on a current $I_{LD}$ from the lower transistor Q2, thereby displaying images. The organic light emitting element LD includes an organic material uniquely representing at least one primary color such as the three primary colors of red, green, or blue. The organic light emitting device displays a desired image by the spatial sum of the primary colors.

The switching transistor Qs and the upper transistor Q1 may be n-channel field effect transistors (FETs) (hereinafter, referred to as "n-type transistors"), and the driving transistor Qd and the lower transistor Q2 may be p-channel field effect transistors (hereinafter, referred to as "p-type transistors"). Here, the n-type transistor may be an nMOSFET, and the p-type transistor may be a pMOSFET. The n-type transistor and the p-type transistor may include polysilicon or amorphous silicon. Alternatively, the channel types of the transistors Qs, Qd, Q1, and Q2 may be changed. Also, the connections among the transistors Qs, Qd, Q1, and Q2, the capacitor Cst, and the organic light emitting element LD may be changed.

Referring to FIG. 1 again, the scan driver 400 is connected to the scanning signal lines $G_1$-$G_n$ and applies scanning signals to the scanning signal lines $G_1$-$G_n$. A scanning signal is a combination of a high voltage Von for turning on the switching transistors Qs and a low voltage Voff for turning off the switching transistors Qs.

The data driver 500 is connected to the data lines $D_1$-$D_m$ and generates and applies data voltages representing image signals to the data lines $D_1$-$D_m$.

The signal controller 600 controls the operation of the scan driver 400, the data driver 500, and the light emission driver.

Hereinafter, a displaying operation of the organic light emitting device according to the present embodiment will be described.

The signal controller 600 receives an input image signal Din and input control signals ICON from an external graphics controller (not shown). Here, the input control signals ICON are signals for controlling the display of the input image signal Din. The input image signal Din includes luminance information for each pixel PX. The luminance includes a specific number of grays, for example, 1024(=$2^{10}$), 256(=$2^8$), or 64(=$2^6$). The input control signals ICON may include a vertical synchronization signal, a horizontal synchronization signal, a main clock signal, and a data enable signal.

The signal controller 600 appropriately processes the input image signal Din according to the operation conditions of the display panel 300 based on the input image signal Din and the input control signals ICON to generate an output image signal Dout, and generates scan control signals CONT1 and data control signals CONT2. The signal controller 600 outputs the scan control signals CONT1 to the scan driver 400, and outputs the data control signals CONT2 and the output image signal Dout to the data driver 500.

The scan driver 400 converts the scanning signal applied to the scanning signal lines $G_1$-$G_n$ into a high voltage Von according to the scan control signals CONT1 from the signal controller 600. Then, the switching transistors Qs connected to the scanning signal lines $G_1$-$G_n$ are turned on, thereby applying the data voltages applied to the data lines $D_1$-$D_m$ to the control terminals of the driving transistors Qd.

According to the data control signals CONT2 from the signal controller 600, the data driver 500 receives the output image signals Dout for pixels PX in each row, converts the received output image signals Dout into analog data voltages, and applies the analog data voltages to the data lines $D_1$-$D_m$.

The data voltage applied to the driving transistor Qd is stored by the storage capacitor Cst, and the stored voltage is sustained even after the switching transistor Qs is turned off.

The driving transistor Qd, which is turned on by the application of the data voltage, and the upper and lower transistors Q1 and Q2, which are turned on by the application of the first and the second voltages Va and Vb, flow a driving current $I_{LD}$.

The organic light emitting element LD emits light having an intensity that depends on the driving current $I_{LD}$. Accordingly, the corresponding pixel PX displays an image.

The scanning signal is sequentially applied to all of the scanning signal lines $G_1$-$G_n$ by repeating the above-described operations with 1 horizontal period (or "1H"), and an image of one frame is displayed by applying the data voltages to all pixels PX.

Hereinafter, an operation of one pixel PX in an organic light emitting device according to the present embodiment will be described with reference to FIG. 2 and FIG. 3.

Figure 3:
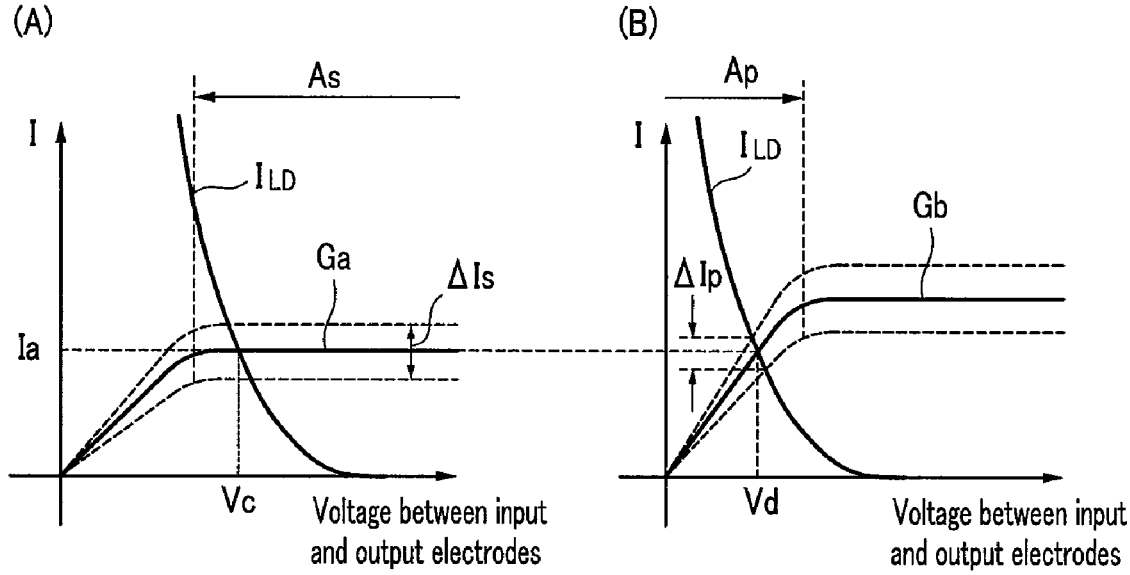
FIG. 3 is a graph showing voltage-current characteristics of a thin film transistor of an organic light emitting device according to an exemplary embodiment of the present invention.

FIG. 3 is a graph showing voltage-current characteristics of a thin film transistor of an organic light emitting device according to an exemplary embodiment of the present invention.

As shown in FIG. 3(B), the driving transistor Qd operates in the condition that a curve of the driving current $I_{LD}$ meets the voltage-current characteristic curve Gb of the driving transistor Qd in a linear region AP. On the contrary, the upper and lower transistors Q1 and Q2, as shown in FIG. 3(A), operate in the condition that a curve of the driving current $I_{LD}$ meets the voltage-current characteristic curve Ga of the transistors Q1 and Q2 in a saturation region As. Here, a voltage (Vd=V2−V3) between the input terminal and the output terminal of the driving transistor Qd is smaller than a voltage (Vc=V1−V2 or V3−V4) between the input terminal and the output terminal of the upper/lower transistor Q1/Q2 for a same driving current 1*a*.

As shown in FIG. 3(B), the deviation ΔIp of the driving current $I_{LD}$ of the driving transistor Qd operating in the linear region Ap is smaller than the deviation ΔIs of the driving current $I_{LD}$ in the case where the driving transistor Qd operates in the saturation region when the characteristics of the driving transistor Qd are changed. Meanwhile, when the upper transistor Q1 connected to the driving voltage Vdd terminal and the lower transistor Q2 connected to the organic light emitting element LD operate in the saturation region As, the driving current $I_{LD}$ is hardly changed as shown in FIG. 3(A), even when deviation of a voltage is generated at the driving voltage Vdd terminal and the common voltage Vss terminal.

Referring to FIG. 2, conditions such that the driving transistor Qd, which is a p-type transistor, operates in the linear region Ap, and the upper transistor Q1, which is an n-type transistor, and the lower transistor Q2, which is a p-type transistor, operate in the saturation region As, are equivalent to the following equation.

$$Va-V2-Vt1 \leqq V1-V2$$

$$V2-Vg-|Vtd| \geqq V2-V3$$

$$V3-Vb-|Vt2| \leqq V3-V4 \quad \text{(Equation 1)}$$

In Equation 1, Vt1, Vtd, and Vt2 denote threshold voltages of the upper transistor Q1, the driving transistor Qd, and the lower transistor Q2, respectively.

If the first and second voltages Va and Vb are determined, and the transistors Qd, Q1, and Q2 are configured to satisfy the above conditions, the driving current $I_{LD}$ may be less sensitive to the variation of the characteristics of the driving transistor Qd, and the driving current $I_{LD}$ may be prevented from deviating even though the driving voltage Vdd and the common voltage Vss are varied.

Hereinafter, an organic light emitting device according to another exemplary embodiment of the present invention will be described with reference to FIG. 4 to FIG. 9.

FIG. 4 to FIG. 9 are equivalent circuit diagrams of one pixel in an organic light emitting device according to another exemplary embodiment of the present invention.

Figure 4:
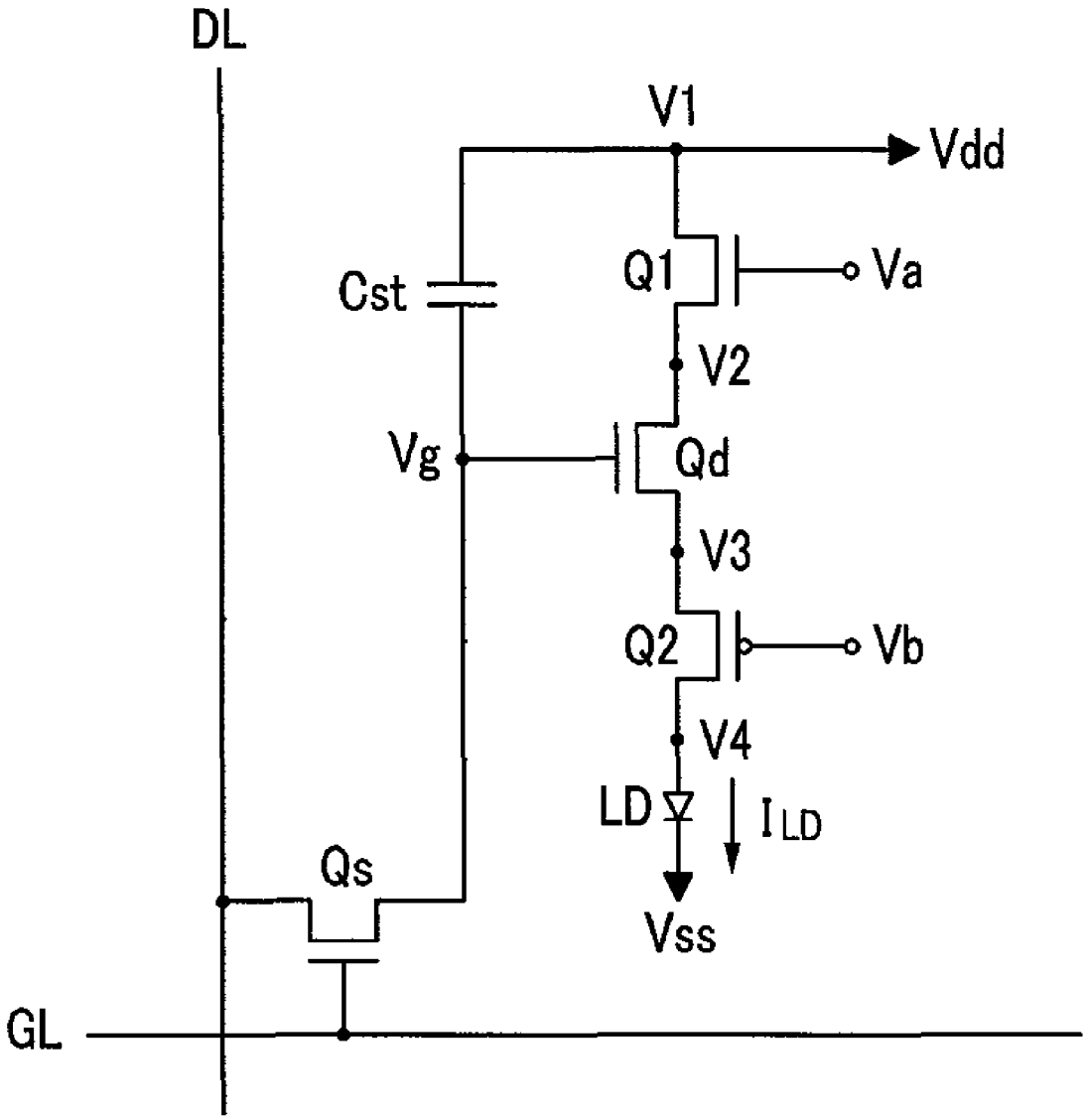
FIG. 4 to FIG. 9 are equivalent circuit diagrams of one pixel in an organic light emitting device according to another exemplary embodiment of the present invention.

Referring to FIG. 4, the driving transistor Qd is an n-type transistor, unlike FIG. 2. Therefore, a condition that enables the driving transistor Qd to operate in the linear region Ap, and the upper and lower transistors Q1 and Q2 to operate in the saturation region Ad is as follows.

$$Va-V2-Vt1 \leqq V1-V2$$

$$Vg-V3-Vtd \geqq V2-V3$$

$$V3-Vb-|Vt2| \leqq V3-V4 \quad \text{(Equation 2)}$$

Figure 5:
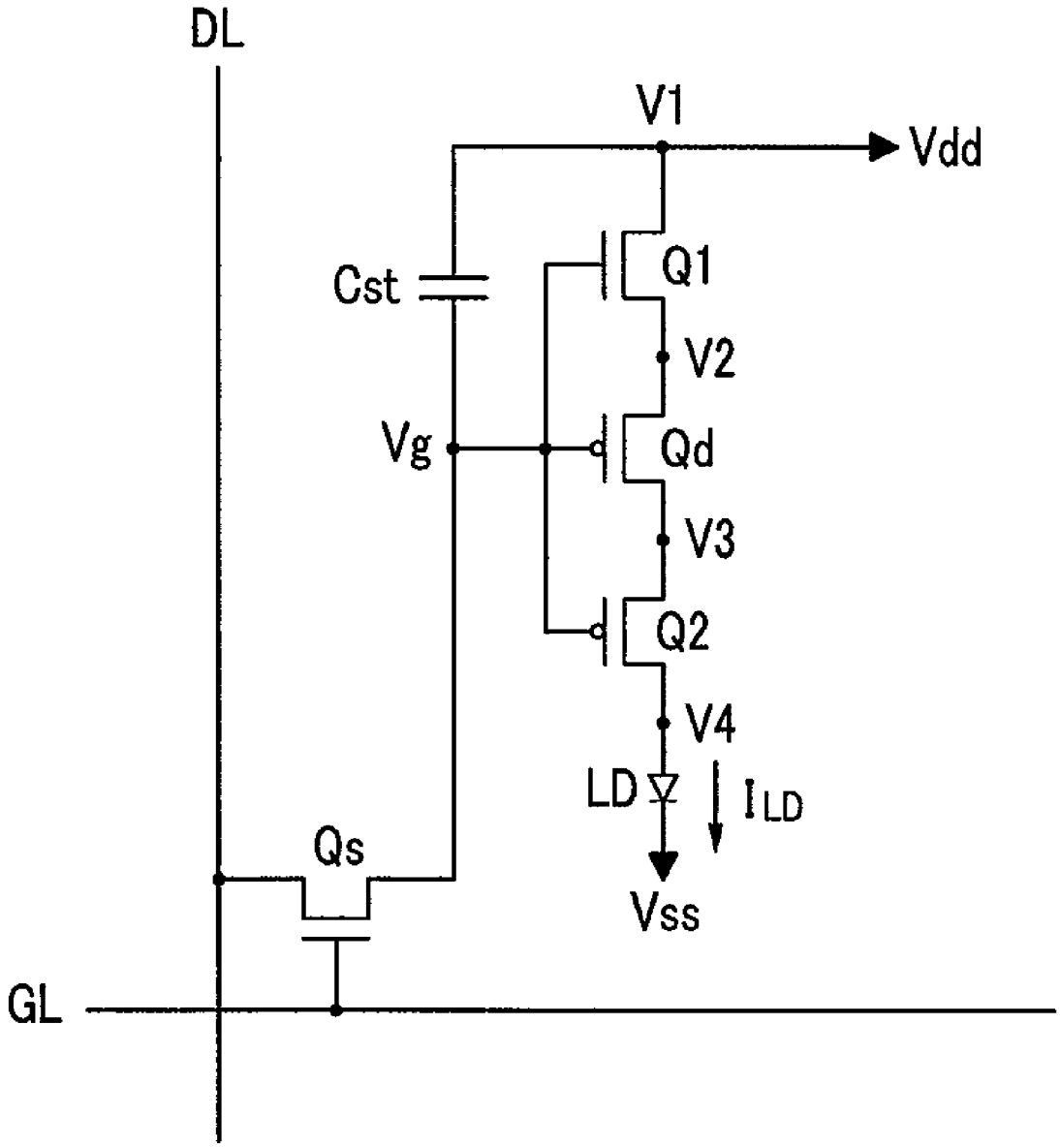

Referring to the embodiment of FIG. 5, the control terminals of the upper and lower transistors Q1 and Q2 are not connected to respective power supplies like in the embodiment of FIG. 2, but instead, both are connected to the output terminal of the switching transistor Qs. Therefore, the same data voltage is applied to the control terminals of the driving transistor Qd and the upper and the lower transistors Q1 and Q2.

Meanwhile, values of the ratio W/L of a channel width to a channel length of the driving transistor Qd and the lower transistor Q2 is regulated to enable the driving transistor Qd and the lower transistor Q2, which have the same channel type, to operate in the linear area Ap and the saturation area As, respectively. That is, the ratio W/L of a channel width to a channel length of the driving transistor Qd is regulated to be smaller than the ratio W/L of a channel width to a channel length of the lower transistor Q2 in order to satisfy the following conditions.

$$Vg-V2-Vt1 \leqq V1-V2$$

$$V2-Vg-|Vtd| \geqq V2-V3$$

$$V3-Vg-|Vt2| \leqq V3-V4 \quad \text{(Equation 3)}$$

Figure 6:
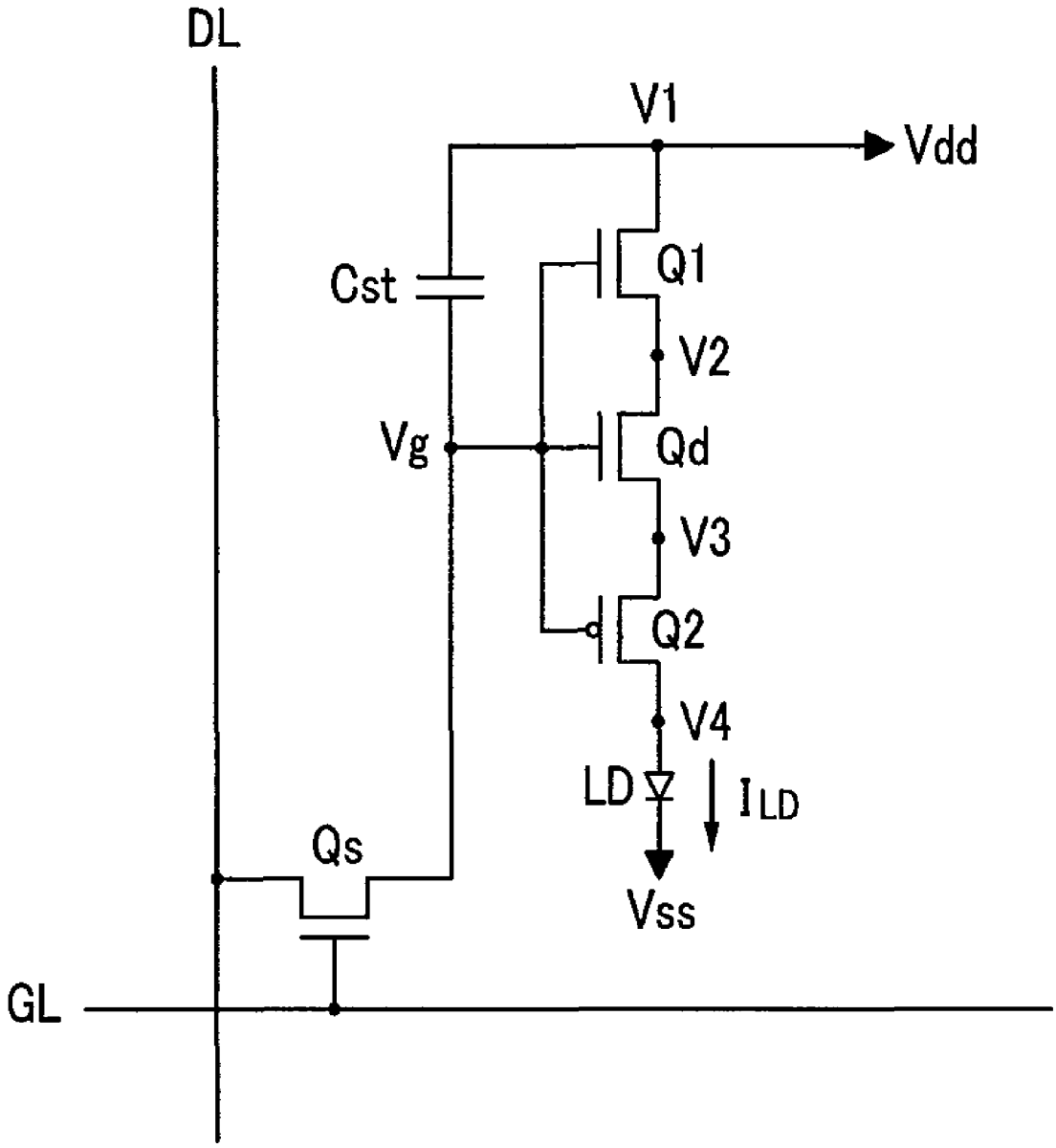

In the organic light emitting device according to another exemplary embodiment shown in FIG. 6, the driving transistor Qd is an n-type transistor, unlike the embodiment of FIG. 5. Therefore, a condition for enabling the driving transistor Qd to operate in the linear region Ap, and the upper and lower transistors Q1 and Q2 to operate in the saturation region As, is equivalent to the following equation.

$$Vg-V2-Vt1 \leqq V1-V2$$

$$Vg-V3-Vtd \geqq V2-V3$$

$$V3-Vg-|Vt2| \leqq V3-V4 \quad \text{(Equation 4)}$$

Figure 7:
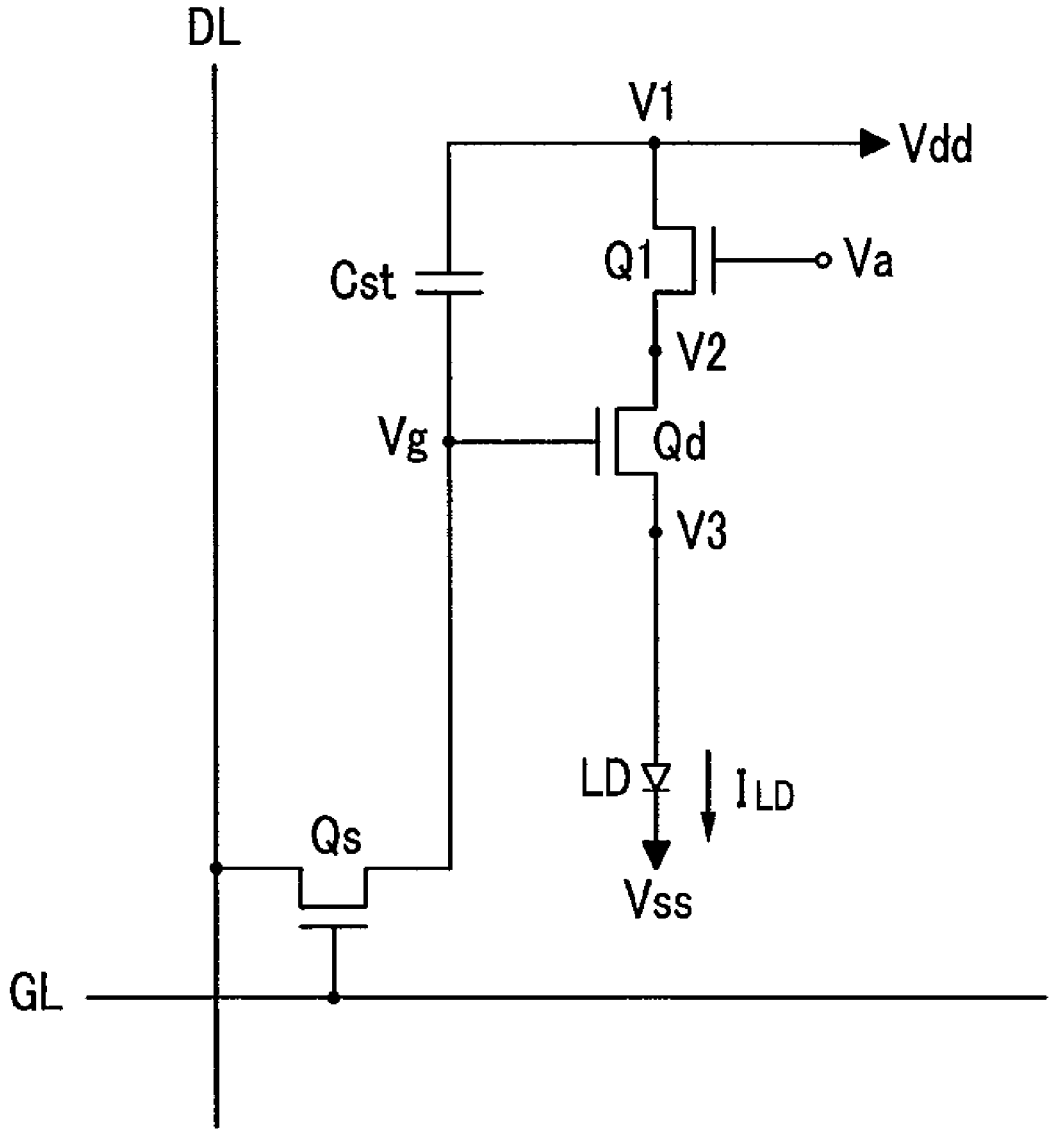

An organic light emitting device according to another exemplary embodiment shown in FIG. 7 includes only an upper transistor Q1 and a driving transistor Qd without the lower transistor Q2 as shown in the previous exemplary embodiment of FIG. 4. Therefore, it is possible to minimize the deviation of the driving current $I_{LD}$, which is caused by the deviation of the driving voltage Vdd and the common voltage Vss.

Figure 8:
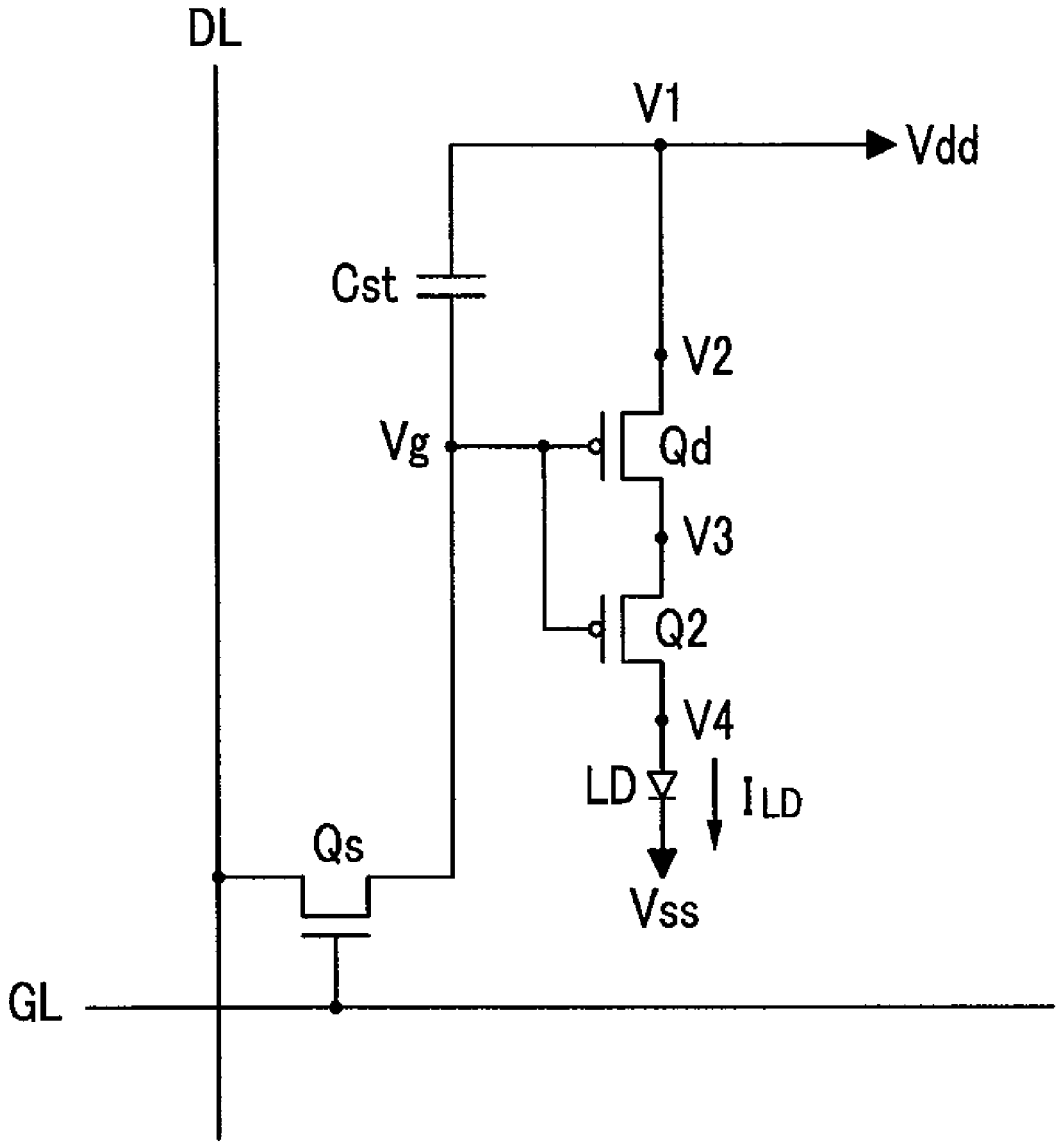

In contrast, an organic light emitting device according to another exemplary embodiment as shown in FIG. 8 includes only a lower transistor Q2 and a driving transistor Qd without the upper transistor Q1 shown in the embodiment of FIG. 5. Also, the driving transistor Qd and the upper transistor Q1 are p-type transistors.

In the present exemplary embodiment, the ratio W/L of a channel width to a channel length of the driving transistor Qd may be controlled to be smaller than the ratio W/L of a channel width to a channel length of the lower transistor Q2 so as to enable the driving transistor Qd to operate in the linear region Ap and the lower transistor Q2 to operate in the saturation region As. In this way, it is possible to minimize the deviation of the driving current $I_{LD}$ that is caused by the deviation of the driving voltage Vdd and the common voltage Vss.

Figure 9:
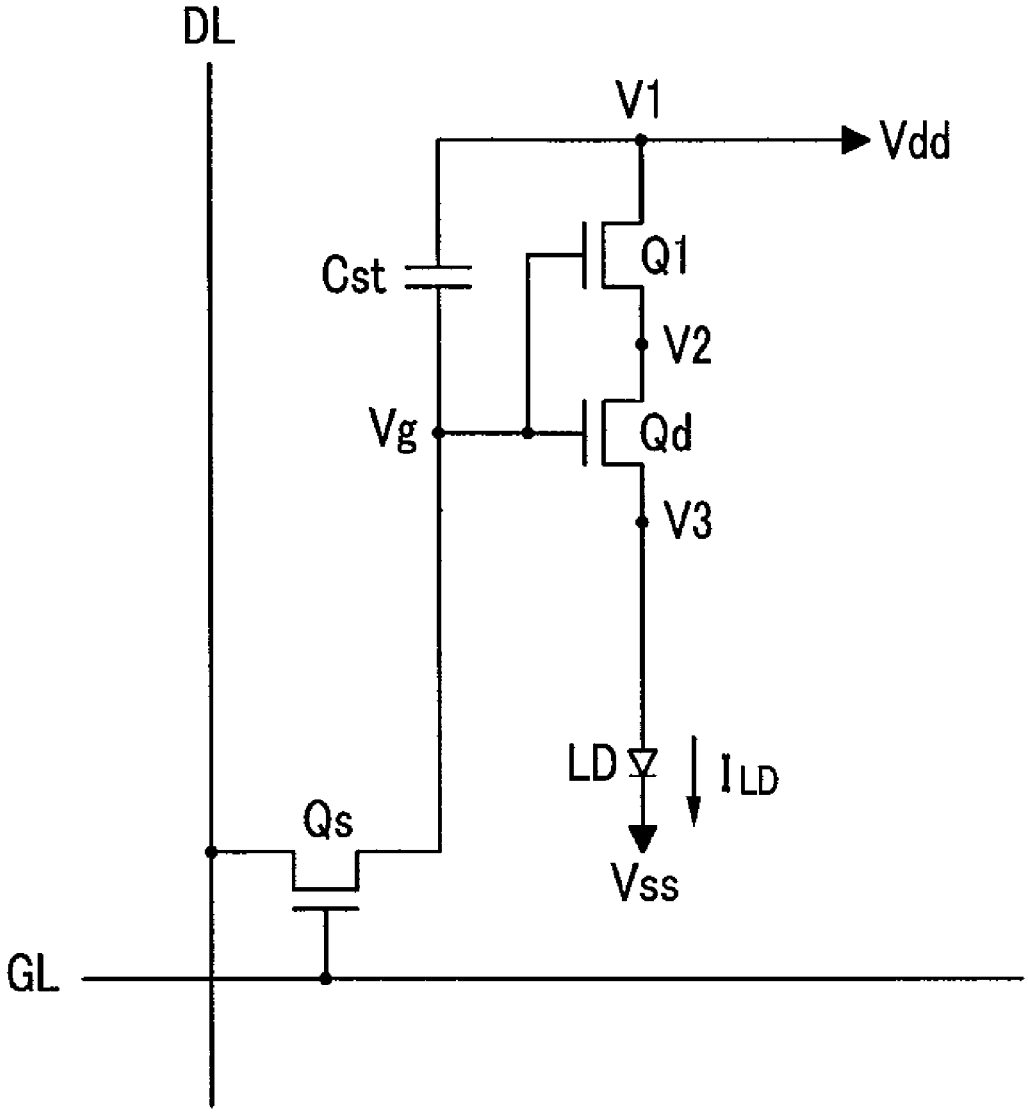

Unlike the organic light emitting device shown in the embodiment of FIG. 6, an organic light emitting device according to another exemplary embodiment shown in FIG. 9 includes only an upper transistor Q1 and a driving transistor Qd without the lower transistor Q2 shown in the embodiment of FIG. 6. Also, the driving transistor Qd and the upper transistor Q1 are n-type transistors.

In the present exemplary embodiment, the driving transistor Qd is enabled to operate in the linear region Ap and the upper transistor Q1 is enabled to operate in the saturation region As by controlling the ratio W/L of a channel width to a channel length of the driving transistor Qd to be smaller than the ratio W/L of a channel width to a channel length of the upper transistor Q1. Therefore, it is possible to minimize the deviation of the driving current $I_{LD}$, which is caused by the deviation of the driving voltage Vdd and the common voltage Vss.

As described above, the driving transistor Qd supplied with a data voltage is enabled to operate in the linear region Ap, and the upper transistor Q1 or the lower transistor Q2 connected with the driving voltage Vdd or the common voltage Vss is enabled to operate in the saturation region As. Therefore, it is possible to minimize the deviation of the driving current $I_{LD}$ that flows to the organic light emitting element LD even though the characteristics of the transistor Qd are varied or the voltage between the input terminal and the output terminal of the upper transistor Q1 or the lower transistor Q2 is varied.

According to one or more exemplary embodiments of the present invention, it is possible to reduce the influence of the characteristics deviation of the driving transistor on the driving current. Also, it is possible to reduce the deviation of the driving current that is caused by the deviation of the driving voltage or the common voltage.

While practical exemplary embodiments have been described, it is to be understood that the disclosure is not limited to the disclosed embodiments, but, on the contrary, is intended to cover various modifications and equivalent arrangements included within the spirit and scope of the appended claims.

What is claimed is:

1. A display device comprising:

a scanning signal line for transferring a scanning signal;

a data line crossing the scanning signal line and transferring a data voltage;

a switching transistor connected to the scanning signal line and the data line;

a driving transistor connected to the switching transistor;

a first transistor connected between the driving transistor and a driving voltage terminal; and a light-emitting element connected between the driving transistor and a common voltage terminal, wherein the first transistor operates in a saturation region when receiving a driving voltage from the driving voltage terminal, and the driving transistor operates in a linear region when the first transistor operates in the saturation region.

2. The display device of claim 1, wherein the first transistor has a channel type identical to a channel type of the driving transistor.

3. The display device of claim 2, wherein the first transistor and the driving transistor are n-channel MOS field effect transistors.

4. The display device of claim 3, wherein a control terminal of the first transistor is connected to a first voltage terminal, and a control terminal of the driving transistor is connected to an output terminal of the switching transistor.

5. The display device of claim 3, wherein a control terminal of the first transistor and a control terminal of the driving transistor are connected to an output terminal of the switching transistor.

6. The display device of claim 5, wherein a ratio of a channel width to a channel length of the driving transistor is smaller than a ratio of a channel width to a channel length of the first transistor.

7. The display device of claim 1, further comprising a storage capacitor connected between the switching transistor and the first transistor.

8. The display device of claim 1, further comprising a second transistor connected between the driving transistor and the light-emitting element and operating in a saturation region.

9. The display device of claim 8, wherein the driving transistor is a p-channel MOS field effect transistor.

10. The display device of claim 9, wherein the first transistor is an n-channel MOS field effect transistor, and the second transistor is a p-channel MOS field effect transistor.

11. The display device of claim 10, wherein a control terminal of the first transistor is connected to a first voltage terminal, a control terminal of the driving transistor is connected to an output terminal of the switching transistor, and a control terminal of the second transistor is connected to a second voltage terminal.

12. The display device of claim 10, wherein a control terminal of the first transistor, a control terminal of the driving transistor, and a control terminal of the second transistor are connected to an output terminal of the switching transistor.

13. The display device of claim 12, wherein a ratio of a channel width to a channel length of the driving transistor is smaller than a ratio of a channel width to a channel length of the second transistor.

14. The display device of claim 8, wherein the driving transistor is an n-channel MOS field effect transistor.

15. The display device of claim 14, wherein the first transistor is an n-channel MOS field effect transistor, and the second transistor is a p-channel MOS field effect transistor.

16. The display device of claim 15, wherein a control terminal of the first transistor is connected to a first voltage terminal, a control terminal of the driving transistor is connected to an output terminal of the switching transistor, and a control terminal of the second transistor is connected to a second voltage terminal.

17. The display device of claim 15, wherein a control terminal of the first transistor, a control terminal of the driving transistor, and a control terminal of the second transistor are connected to an output terminal of the switching transistor.

18. The display device of claim 17, wherein a ratio of a channel width to a channel length of the driving transistor is smaller than a ratio of a channel width to a channel length of the first transistor.

* * * * *